US005738326A

United States Patent [19]

Liao

[11] Patent Number: 5,738,326

[45] Date of Patent: Apr. 14, 1998

[54] SEAT STEM POSITIONING STRUCTURE OF A CHAIR FOR DRUMMER

[75] Inventor: Tsun-Chi Liao, Taichung, Taiwan

[73] Assignee: Hwa Shin Musical Instrument Co. Ltd., Taichung, Taiwan

[21] Appl. No.: 731,479

[22] Filed: Oct. 16, 1996

[51] Int. Cl.[6] ..... F16M 11/26

[52] U.S. Cl. ..... 248/405; 248/406.1; 248/188.4; 297/344.12; 297/461

[58] Field of Search ..... 297/344.12, 344.18, 297/461; 248/405, 406.1, 170, 188.4, 415

[56] References Cited

U.S. PATENT DOCUMENTS

| | | | |
|---|---|---|---|
| 434,743 | 8/1890 | Trapp | 248/415 X |
| 1,723,363 | 8/1929 | McArdle | 248/405 X |
| 1,937,892 | 12/1933 | Huntley | 248/406.1 |
| 2,412,451 | 12/1946 | Foote | 248/406.1 |
| 2,508,932 | 5/1950 | Turner | 248/405 X |
| 4,366,940 | 1/1983 | Vargas | 248/170 X |
| 4,828,212 | 5/1989 | Dicks | 297/344.12 X |

*Primary Examiner*—Peter R. Brown
*Assistant Examiner*—Stephen Vu
*Attorney, Agent, or Firm*—Bacon & Thomas

[57] ABSTRACT

A seat stem positioning structure for a chair for drummer, including an internally threaded seat stem connector shaped like a stepped tube and fastened to a tubular central shaft and equipped with pivoted legs for supporting on the ground, a threaded seat stem having a screw section threaded into the seat stem connector to hold a seat for sitting, and a clamping device fastened to the seat stem connector and the threaded seat stem by fastening means to firmly secure them together, the clamping device including two hinged clamping plates having a respective connecting plate at the respective free end fastened to each other by a screw and a wing nut, and a respective downward locating rod forced into engagement with a respective locating notch in a step at the seat stem connector.

3 Claims, 7 Drawing Sheets

SEAT STEM POSITIONING STRUCTURE OF A CHAIR FOR DRUMMER

BACKGROUND OF THE INVENTION

The present invention relates to parts of chairs for drummers, and relates more particularly to the seat stem positioning structure of a chair for drummer.

A regular chair for drummer as shown in FIGS. 1 and 2 is generally comprised of a stand, which is comprised of a tubular central shaft and hinged legs, a tubular seat stem connector fixedly fastened to the tubular central shaft of the stand, a seat stem having a top end connected to a seat and a bottom end terminating in a screw section threaded into the inner thread of the tubular seat stem connector, a locating cup threaded onto the screw section of the seat stem and covered on the top of the seat stem connector, and a tightening up screw threaded into a radial screw hole in the locating cup and stopped against the periphery of the seat stem connector to fix the locating cup to the seat stem connector. This seat stem positioning structure is complicated to install. During the assembly process, the locating cup must be threaded onto the screw section of the seat stem before the seat stem is fastened to the seat stem connector. Another drawback of this seat stem positioning structure is that the seat stem connector wears with use quickly. Still another drawback of this seat stem positioning structure is that the locating cup tends to be turned with the seat stem when the seat is rotated by high torsional force. Furthermore, when the tightening up screw is loosened, the locating cup must be held in one hand so that the seat stem can be turned relative to the locating cup to adjust the elevation of the seat, therefore the desired elevation is achieved usually after several trials.

SUMMARY OF THE INVENTION

It is one object of the present invention to provide a seat stem positioning structure for a chair for drummer which is easy to install. It is another object of the present invention to provide a seat stem positioning structure which firmly secure the seat stem at the desired elevation when fixed. It is still another object of the present invention to provide a seat stem positioning structure which is durable in use. To achieve the aforesaid objects, there is provided a seat stem positioning structure comprised of an internally threaded seat stem connector shaped like a stepped tube and fastened to a tubular central shaft and equipped with pivoted legs for supporting on the ground, a threaded seat stem having a screw section threaded into the seat stem connector to hold a seat for sitting, and a clamping device fastened to the seat stem connector and the threaded seat stem by fastening means to firmly secure them together. The clamping device is comprised of two symmetrical clamping plates hinged together. The clamping plates have a respective arched upper section fitting over the periphery of the threaded seat stem, a respective arched lower section fitting over the periphery of the reduced top end of the internally threaded seat stem connector, respective threads disposed at the respective arched upper section at an inner side for engagement with the threaded periphery of the threaded seat stem, a respective downward locating rod axially downwardly raised from the respective arched lower section and adapted for fitting into a respective locating notch at a step on the internally threaded seat stem connector, a respective connecting plate radially raised from the respective arched upper section and arched lower section at one lateral side, and a respective locating hole at the respective connecting plate respectively connected together by a screw and wing nut.

DETAILED DESCRIPTION OF THE PREFERRED EMBODIMENT

Figure 1:
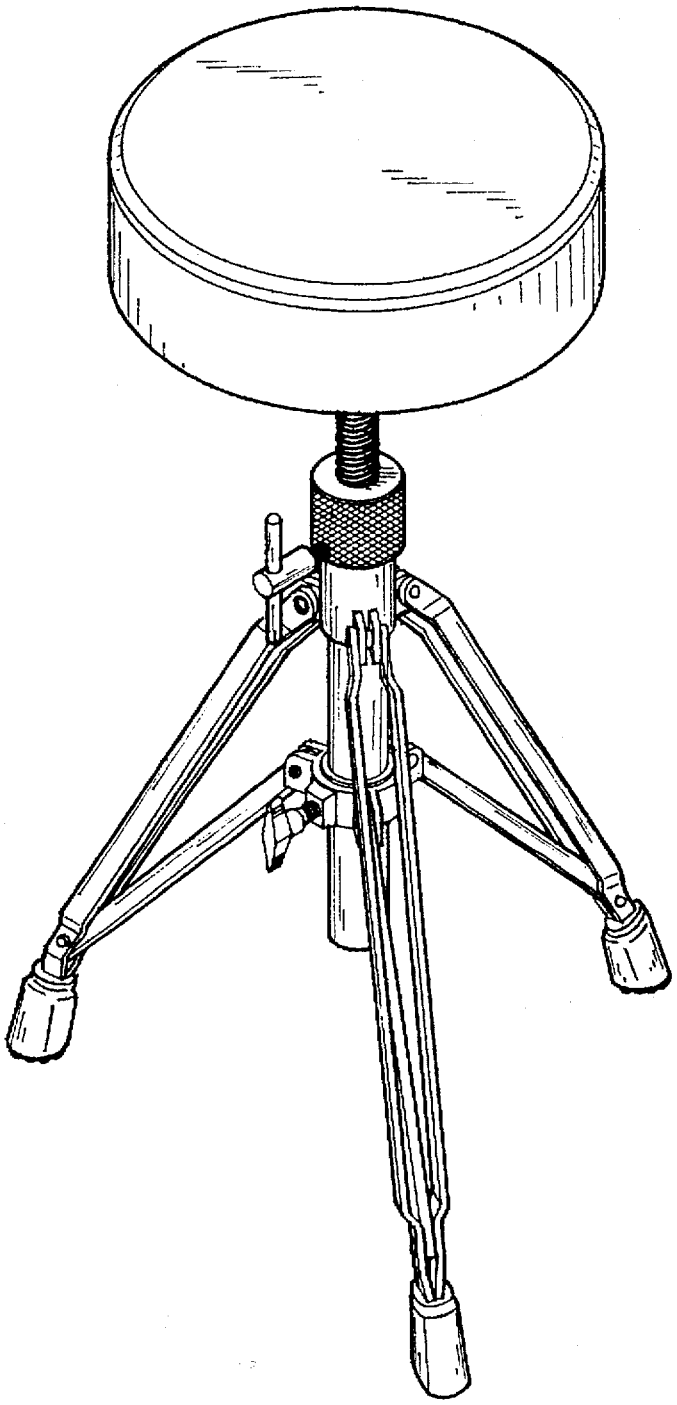
Fig .1 PRIOR ART
FIG. 1 is an elevational view of a conventional chair drummer.
Figure 2:
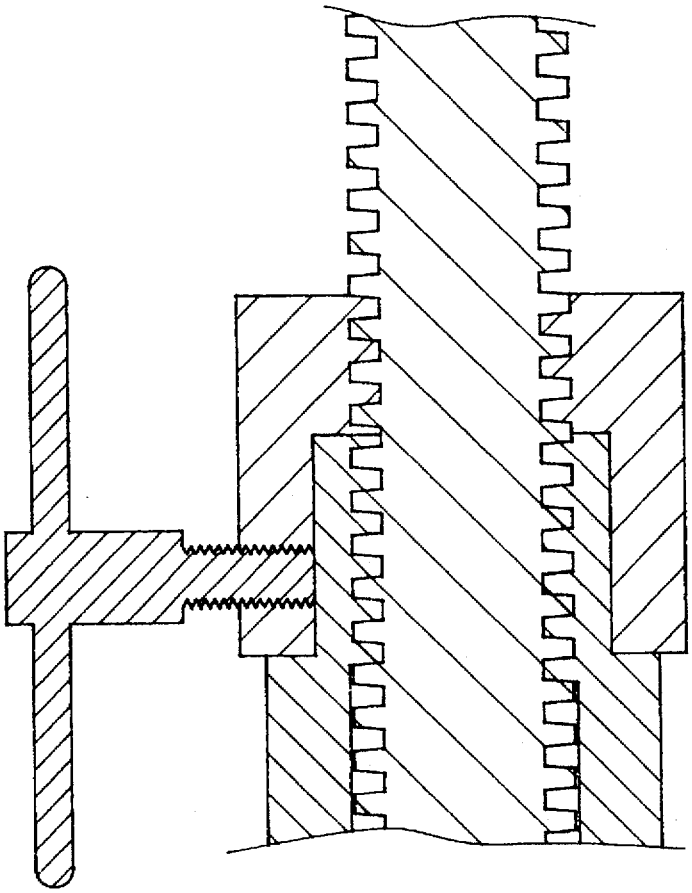
Fig.2 PRIOR ART
FIG. 2 is a sectional view in an enlarged scale of a part of FIG. 1, showing the adjustment cup mounted around the threaded seat stem and fixed to the threaded seat stem connector.
Figure 3:
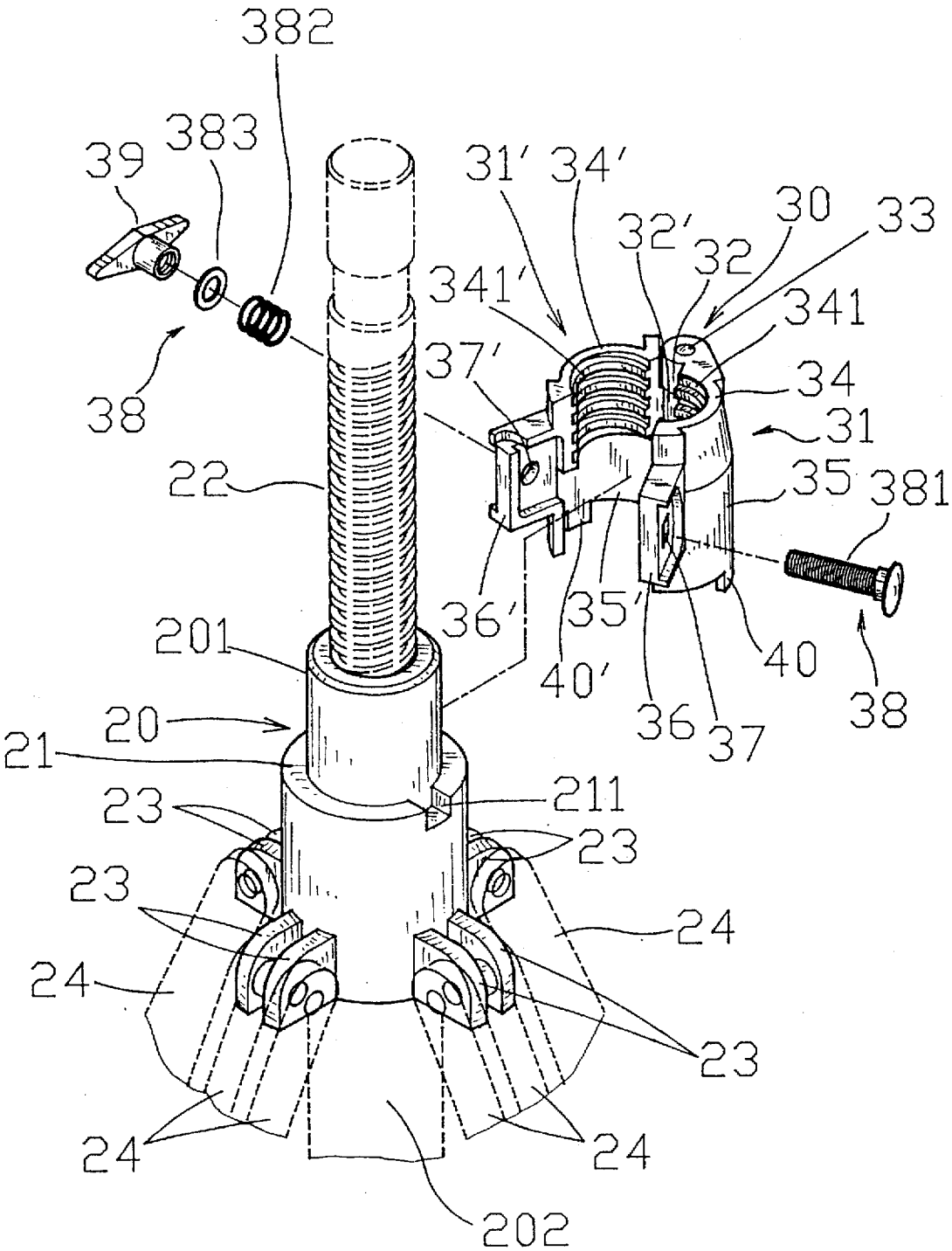
FIG. 3 is an exploded view of the present invention.
Figure 4:
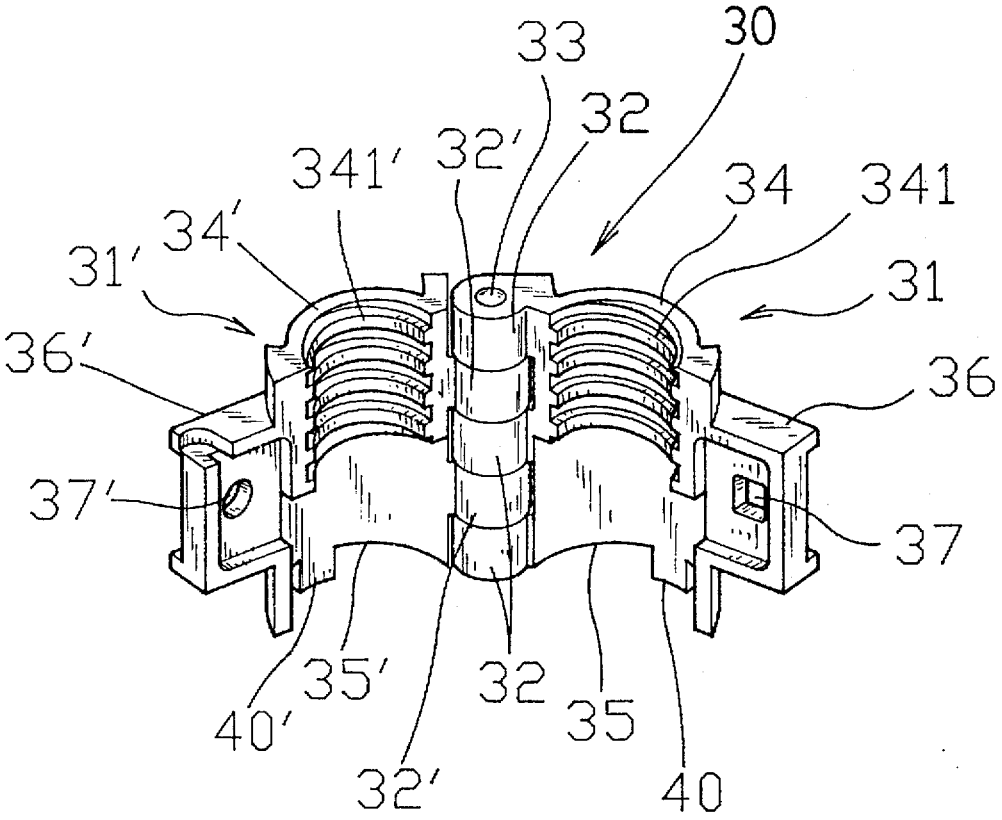
FIG. 4 is an extended view of the clamping device shown in FIG. 3.
Figure 5:
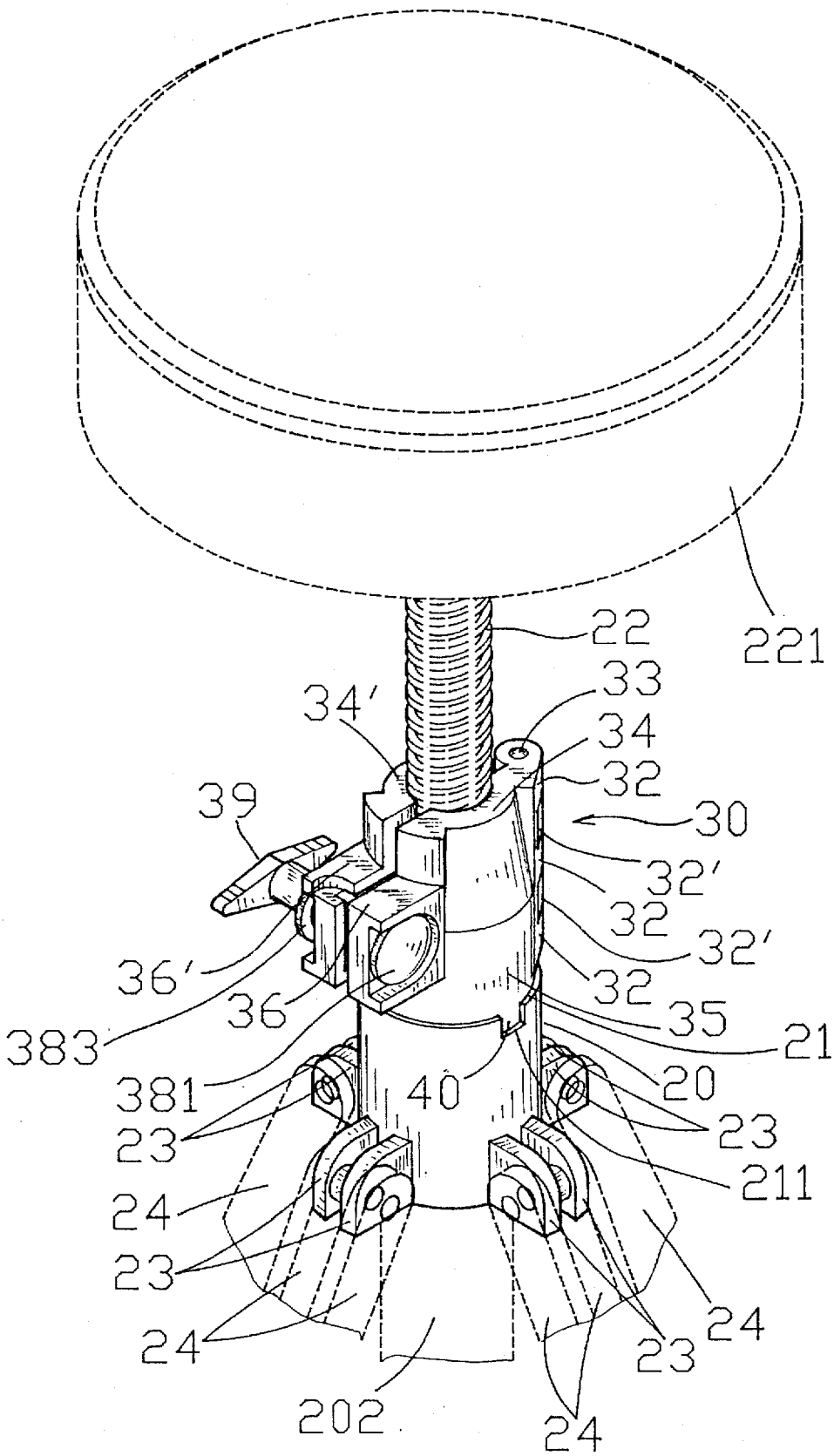
FIG. 5 is an installed view of the present invention.

Referring to FIGS. 3, 4, and 5, the present invention is generally comprised of a seat stem connector 20 fastened to a tubular central shaft 202 at the top, a threaded seat stem 22 fastened to the seat stem connector 20, and a clamping device 30 fastened to the seat stem connector 20 and the threaded seat stem 22 to secure them together firmly. The seat stem connector 20 is shaped like a stepped tube, comprising a top extension tube of reduced outer diameter 201, which is internally threaded and threaded onto the threaded seat stem 22, a step around the root of the top extension tube 201, two location notches 211 at the step 21 at two opposite locations, a plurality of equiangularly spaced lugs 23, and a plurality of legs 24 respectively pivoted to the lugs 23 for supporting on the ground. The threaded seat stem 22 is connected to a seat 221, and adapted for threading into the internally threaded top extension tube 201 of the seat stem connector 20. The clamping device 30 is comprised of two symmetrical, substantially arched clamping plates 31 and 31' fastened to the threaded seat stem 22 and the seat stem connector 20 by a fastening device 38. The clamping plates 31 and 31' have respective knuckles 32 32 and 32' pivotably connected together by a pivot pin 33, a respective arched upper section 34 or 34' fitting over the periphery of the threaded seat stem 22, a respective arched lower section 35 or 35' fitting over the periphery of the top extension tube 201 of the seat stem connector 20, respective threads 341 or 341 formed at the inner side of the respective arched upper section 34 or 34' for engagement with the threaded seat stem 22, a respective downward locating rod 40 or 40' axially raised from the respective lower section 35 or 35' at the bottom and adapted for fitting into the locating notches 211 of the seat stem connector 20 respectively, and a respective connecting plate 36 or 36' radially raised from the respective arched upper section 34 or 34' and arched lower section 35 or 35' at the free end. The connecting plate 36 or 36' has a locating hole 37 or 37' The locating hole 37 of one connecting plate 36 has a rectangular shape while the locating hole 37' of the other connecting plate 36 has a rounded shape. The fastening device 38 is fastened to the locating holes 37 and 37' of the connecting plates 36 and 36' to fix the clamping device 30 to the threaded seat stem 22 and the seat stem connector 20, comprising a flat head screw with a square neck design 381, a wing nut 39, a compression spring 382, and a washer 383.

Referring to FIGS. from 3 to 5 again, when the threaded seat stem 22 is threaded into the internally threaded top extension tube 201 of the seat stem connector 20 and adjusted to the desired elevation, the clamping plates 31 and 31' of the clamping device 30 are attached to the threaded seat stem 22 and the top extension tube 201 and closed together, permitting the downward locating rods 40 and 40' to be respectively forced into engagement with the locating notches 211 of the seat stem connector 20, and then the flat head screw 381 is inserted in proper order through the locating holes 37 and 37' of the connecting plates 36 and 36', the compression spring 382, and the washer 383, permitting the square neck of the flat head screw 381 to be fitted into the square locating hole 37', and then the wing nut 39 is threaded onto the flat head screw 381 to secure the connecting plates 36 and 36' together. When the wing nut 39 is fastened tight, the clamping plate 30 is firmly fixed to the threaded seat stem 22 and the seat stem connector 20, and the threads 341 and 341' of the arched upper sections 34 and 34' of the clamping plates 31 and 31' are forced into engagement with the threads of the threaded seat stem 22 to stop it from axial movement relative to the seat stem connector 20. Because the downward locating rods 40 and 40' of the clamping plates 31 and 31' are forced into engagement with the locating notches 211 of the seat stem connector 20 respectively, the clamping device 30 is stopped from rotary motion relative to the seat stem connector 20. When the wing nut 39 is loosened, the threaded seat stem 22 can be turned downwards or upwards to adjust the elevation of the seat 221. When adjusted, the wing nut 39 is fastened tight again to secure the threaded seat stem 22 in the adjusted position.

Figure 6:
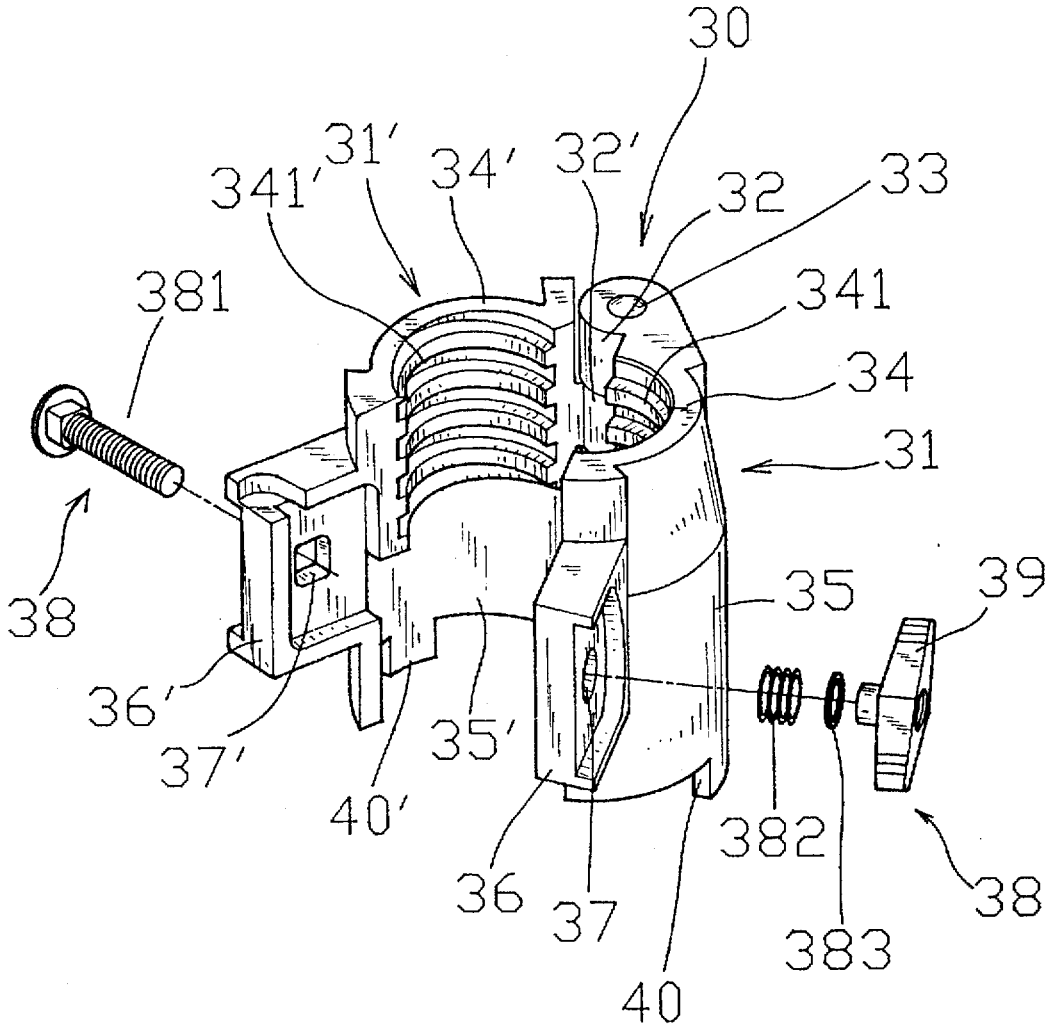
FIG. 6 shows an exploded view of an alternate form of the clamping device according to the present invention; and, FIG. 7 is an exploded view of another alternate form of the clamping device according to the present invention.

FIG. 6 shows an alternate form of the present invention in which the locating hole 37' of the left connecting plate 36' has a square shape adapted for receiving the square neck of the flat head screw 381; the locating hole 37 of the right connecting plate 36 has a rounded shape for the passing of the screw body of the flat head screw 381. This design fits right-handed persons.

Figure 7:
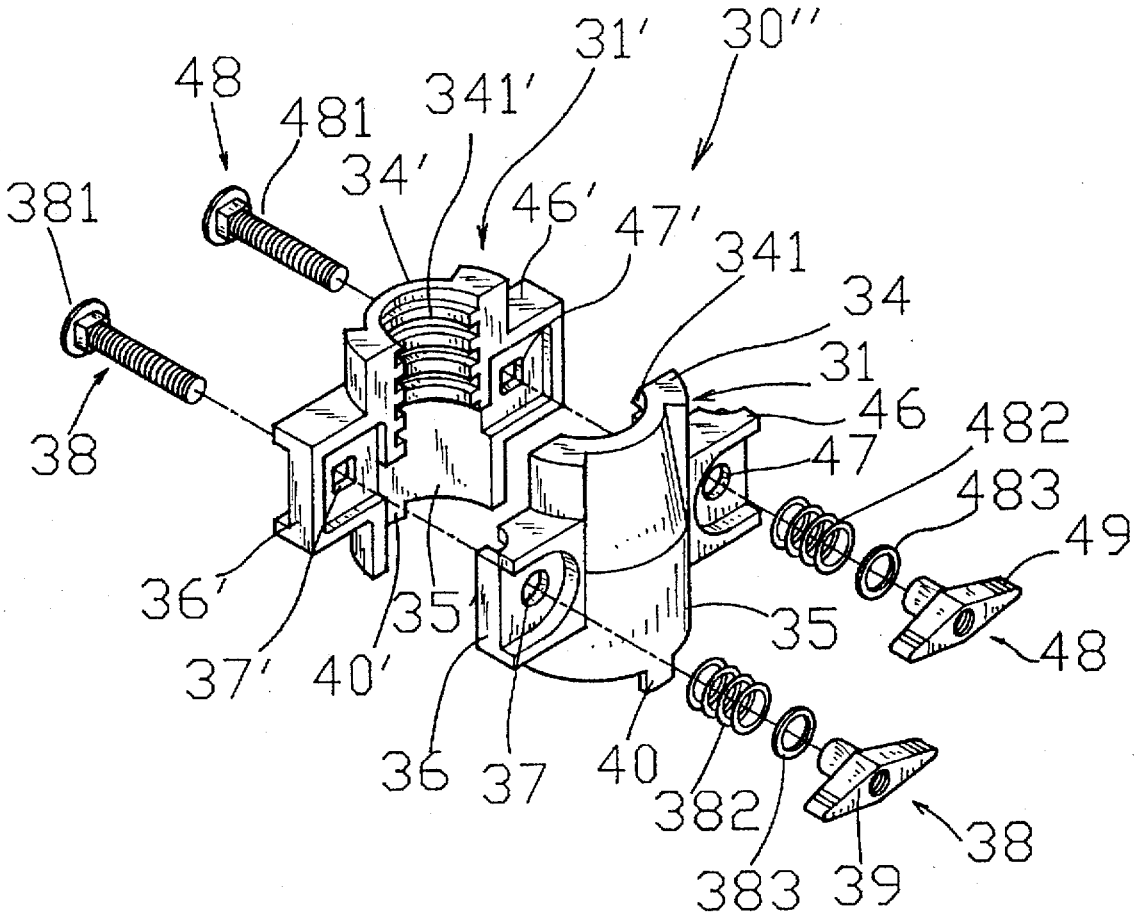

FIG. 7 shows another alternate form of the clamping device. According to this alternate form, the clamping plates 31 and 31' of the clamping device 30" are not hinged together. The structure of the clamping plates 31 and 31' is similar to that shown in FIG. 4, however the aforesaid knuckles 32 and 32' are eliminated from the clamping plates 31 and 31', and the clamping plates 31 and 31' have a respective addition connecting plate 46 or 46' radially raised from the respective arched upper section 34 or 34' and arched lower section 35 or 35' opposite to the connecting plates 36 or 36' and defining a respective locating hole 47 or 47'. When a clamping device of this alternate form is used, an additional fastening device 48 which is comprised of a flat head screw with a square neck design 481, a compression spring 482, a washer 483, and a wing nut 49, shall be installed to fastened the connecting plates 46 and 46' together.

It is to be understood that the drawings are designed for purposes of illustration only, and are not intended as a definition of the limits and scope of the invention disclosed.

I claim:

1. A seat stem positioning structure for a chair, comprising an internally threaded seat stem connector having a stepped tube configuration with an internally threaded top extension tube defining an external step, said internally threaded seat stem connector being fastened to a tubular central shaft and equipped with pivoted leg for supporting the chair on the ground, a threaded seat stem having a screw section threaded into said seat stem connector to hold a seat for sitting, and a clamping device clamped around said seat stem connector and said threaded seat stem to firmly secure them together, wherein:

said seat stem connector comprises two locating notches formed in said step at two opposite locations; and, said clamping device comprises a first clamping plate, a second clamping plate, a first fastening device, and a second fastening device, each of said first and second clamping plates comprising a respective arched upper section fitting over the periphery of said threaded seat stem, a respective arched lower section fitting over the periphery of the top extension tube of said internally threaded seat stem connector, threads disposed on the respective arched upper sections at inner sides to engage the screw section of said threaded seat stem, a respective downward locating rod extending axially downwardly from each of the respective arched lower sections to engage the locating notches of the step of said internally threaded seat stem connector respectively, a coupling section and a connecting plate extending laterally from the respective arched upper section and arched lower section at opposite sides, and a respective locating hole through the respective connecting plate, the coupling sections of said clamping plates being fastened together by said first fastening device, said second fastening device comprising a screw inserted through the locating holes of the connecting plates of said clamping plates, and a wing nut threaded onto said screw to secure the connecting plates of said clamping plates together.

2. The seat stem positioning structure of claim 1 wherein the coupling sections of said clamping plates comprise a plurality of knuckles connected together by said first fastening device; said first fastening device comprising a pivot pin extending through the knuckles of said clamping plates for permitting said clamping plates to be respectively turned thereabout.

3. The seat stem positioning structure of claim 1 wherein the coupling sections of said clamping plates have a respective locating hole connected to each other by said first fastening device; said first fastening device comprising a screw inserted through the locating holes of the coupling sections of said clamping plates, and a wing nut threaded onto the screw of said first fastening device to secure the coupling sections of said clamping plates together.

* * * * *